US005088939A

United States Patent [19]

Shepherd

[11] Patent Number: 5,088,939

[45] Date of Patent: Feb. 18, 1992

[54] ELECTRICAL ASSEMBLIES

[75] Inventor: Brian Shepherd, Wendover, England

[73] Assignee: Smiths Industries Public Limited Company, London, England

[21] Appl. No.: 531,314

[22] Filed: May 31, 1990

[30] Foreign Application Priority Data

Jun. 30, 1989 [GB] United Kingdom ..... 89 15060

[51] Int. Cl.[5] ..... H01R 13/66

[52] U.S. Cl. ..... 439/620; 439/607; 439/182

[58] Field of Search ..... 439/620, 608, 607, 841, 439/843, 847, 851, 857; 333/182, 185

[56] References Cited

U.S. PATENT DOCUMENTS

| | | | |
|---|---|---|---|
| 3,275,953 | 9/1966 | Coda et al. | 333/182 |
| 3,588,758 | 6/1971 | Hurst | 333/183 |
| 3,597,711 | 8/1971 | Buckley | 333/79 |
| 3,858,962 | 1/1975 | Bonhomme | 439/843 |
| 3,961,295 | 6/1976 | Hollyday et al. | 333/182 |
| 4,401,355 | 8/1983 | Young | 439/607 |
| 4,693,002 | 9/1987 | Neumann et al. | 434/843 |
| 4,729,752 | 3/1988 | Dawson, Jr. et al. | 439/620 |
| 4,820,202 | 4/1989 | Edwards et al. | 439/620 |

*Primary Examiner*—Larry I. Schwartz
*Assistant Examiner*—Hien D. Vu
*Attorney, Agent, or Firm*—Pollock, VandeSande and Priddy

[57] ABSTRACT

An electrical connector assembly has several sockets mounted in apertures in a ground plane. Each socket has a metal tube supporting wires that engage the surface of a pin inserted in the socket. Each socket is filtered by means a tubular capacitor one electrode of which is soldered in the aperture and the other electrode of which is electrically connected to the wires. An annular, ferrite inductor embraces the tube within the capacitor. Protection from a transient at any one of the sockets is provided by a transient protector device on a flexible circuit board joined to each socket.

6 Claims, 5 Drawing Sheets

ELECTRICAL ASSEMBLIES

BACKGROUND OF THE INVENTION

This invention relates to electrical assemblies.

The invention is more particularly concerned with electrical assemblies for use in filtering interference and or alternatively suppressing transients.

In GS 2201050A there is described a plug-in electrical connector having a filter assembly on a circuit board. The board also supports sockets of the Hypertac type (Hypertac is a Registered Trade Mark of Hypertac Limited) each having several spring wire elements that contact a respective pin extending through the socket. The filter assembly takes the form of capacitors soldered to the board which extends in a plane at right angles to the axis of the sockets. A tubular inductor bead may extend along the pin itself to provide inductive filtering. Use of sockets in this way enables the filter assembly to be removed and replaced readily while the resilience of the sockets accommodates deflection of the pins and thereby reduces the risk of damage. Such an arrangement has great advantages over previous arrangements but it can be difficult to implement where the pins are densely packed, because of the lack of space available on the circuit board for mounting the capacitors. Testing and replacement of the capacitors can also be difficult.

BRIEF SUMMARY OF THE INVENTION

It is an object of the present invention to provide an improved form of electrical assembly.

According to one aspect of the present invention there is provided an electrical assembly including at least one socket member mounted with and extending through a ground plane member, the socket member being adapted to receive a respective one of one or more pin elements, the socket member including within its wall an electrical device in the form of a capacitor or transient protector.

The socket member may include an electrically-conductive sleeve supporting a plurality of spring wire elements. The electrical device is prefereably a tubular capacitor extending coaxially of the socket member. The spring wire elements may be arranged to contact the surface of the respective pin element, the tubular capacitor being connected intermediate the spring wire elements and the ground plane member. The socket member may include an inductive element which may be annular in shape and arranged coaxially of the socket member. The inductive element is preferably located internally within the tubular capacitor and may be located between the conductive sleeve and the tubular capacitor. The inductive element may contact directly the surface of the respective pin element. The inductive element may embrace the pin element where it emerges from the sleeve member. The inductive element may be of a ferrite. The tubular capacitor may be secured to the respective pin and have an external electrically-conductive surface that is arranged to make a sliding electrical contact with the socket member.

The assembly preferably includes both a capacitor and a transient protector, the transient protector being mounted on a board separate from the ground plane member which board may be flexible. The assembly may include a plurality of socket members mounted with a common ground plane, and a single transient protector connected with each socket member such that an electrical transient at any one of the socket members is dissipated at the transient protector. The socket member may include an electrically-conductive collar embracing the socket member and electrically connected to an aperture in the ground plane, and an electrically-conductive bush arranged to make electrical connection with the respective pin element, and the electrical device being connected between the collar and the bush. An electrical assembly in accordance with the present invention, will now be described, by way of example, with reference to the accompanying drawings.

DETAILED DESCRIPTION OF PREFERRED EMBODIMENTS

Figure 1:
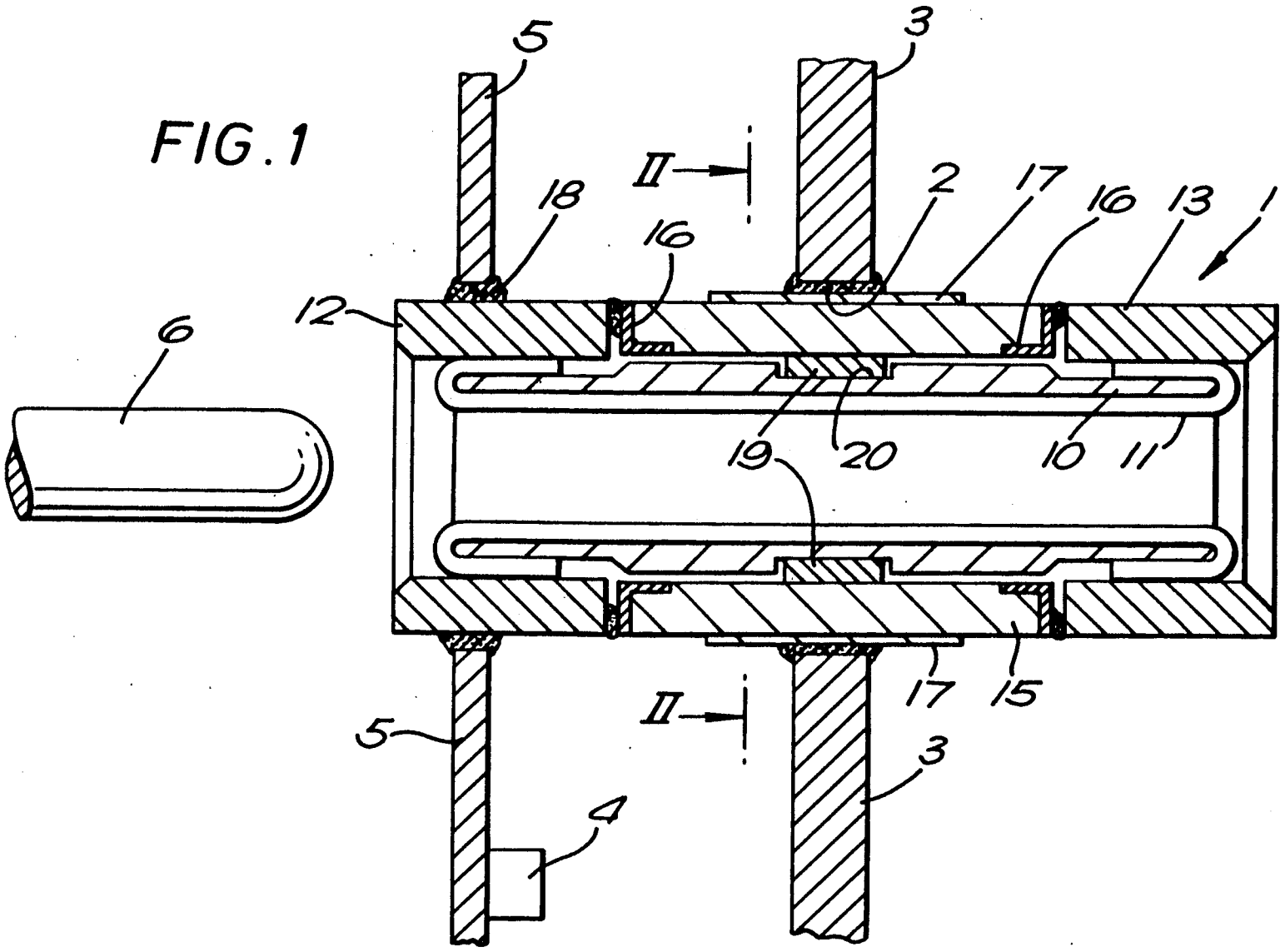
FIG. 1 is a sectional side elevation of the assembly.
Figure 2:
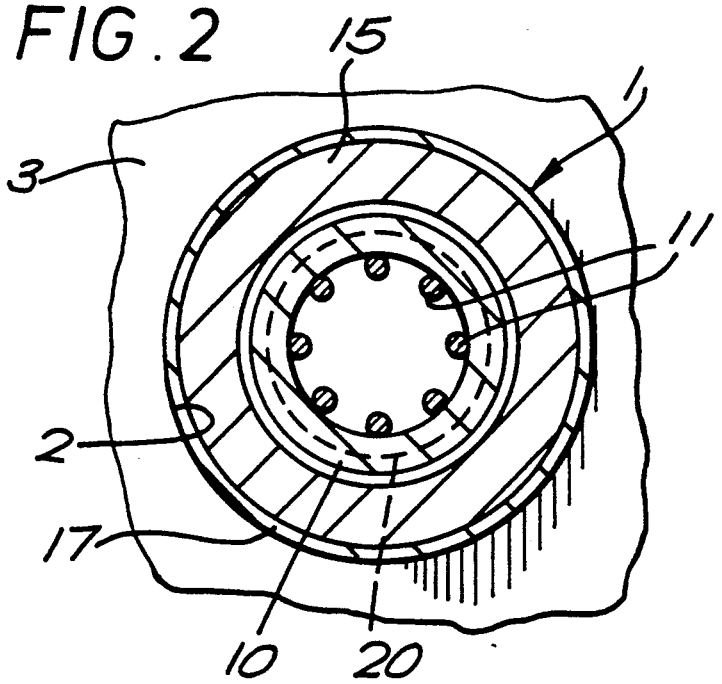
FIG. 2 is a transverse section along the line II—II of FIG. 1.

With reference first to FIGS. 1 and 2, the device comprises several socket members only one of which is shown and indicated generally by the numeral 1. The socket members 1 are each mounted in respective apertures 2 in an electrically-conductive plate 3 that provides a common ground plane. Each socket member 1 is also connected to a transient protection device 4 via a flexible multi-layer printed circuit board 5.

The socket member 1 comprises an inner conductive support tube or sleeve 10 of circular section which extends coaxially substantially the entire length of the socket member. The tube 10 supports several resilient metal wires 11 which extend along the inside of the tube and are arranged obliquely of its axis. The tube 10 is open at both ends, the wires 11 being folded back around the outside of the tube at each end and held in position by respective brass end bushes 12 and 13 which embrace the ends of the tube 10. The arrangement of the wires 11 in the tube 10 form an electrical socket of the kind described in UK Patent Specification 863764 and sold under the trade mark Hypertac. These sockets provide a highly reliable sliding contact by engagement of the wires 11 with a pin element 6 inserted in the socket.

The socket member 1 also includes within its wall a tubular capacitor 15 which extends coaxially around the outside of the tube 10 as a sliding fit and is located intermediate the two end bushes 12 and 13. The capacitor 15 has electrodes 16 at each end which are soldered to respective ones of the bushes 12 and 13, and an outer ring electrode 17 that extends around the outside of the capacitor midway along its length. The outer electrode 17 is soldered into the aperture 2 in the plate 3 so that the capacitor 15 is connected electrically intermediate the wires 11, which contact the pin 6, and the ground plane.

One of the end bushes 12 is soldered around its outer surface into an aperture 18 in the circuit board 5. The circuit board 5 connects the socket member 1 with the transient protection device 4 which may be of any conventional kind, such as a gas-discharge tube, zener diode, transzorb, varactor or the like. One such device 4 can be used to provide transient protection for all the socket members 1 in the assembly and need not, therefore, be located in close proximity to any one of the sockets The socket member 1 can also include an inductive element in the form of an annular bead 19 of a ferrite material. This is located in an annular groove 20 around the outside of the tube 10 midway along its length, so that the bead 19 lies between the support tube 10 and the capacitor 15. In this way, a $\pi$ filter is produced. Alternatively, or additional, a ferrite bead may be pushed over the pin 6 where it projects from the socket member 1 at one or both ends. This produces an L or T filter. Additional capacitors may be mounted on the board 5 if the tubular capacitor 15 is not sufficient.

In use, the pin 6 will extend completely through the socket member 1 to make electrical connection with a second socket (not shown), a solder connection or the like. Any high frequency electrical interference in a signal supplied via the pin 6 will be passed by the filter formed by the capacitor 15 and any inductance 19. If any high voltage transients should occur such as caused by lightning (LEMP) or nuclear explosion (NEMP) this will be conducted via the board 5 and dissipated in the transient protection device 4.

Figure 3:
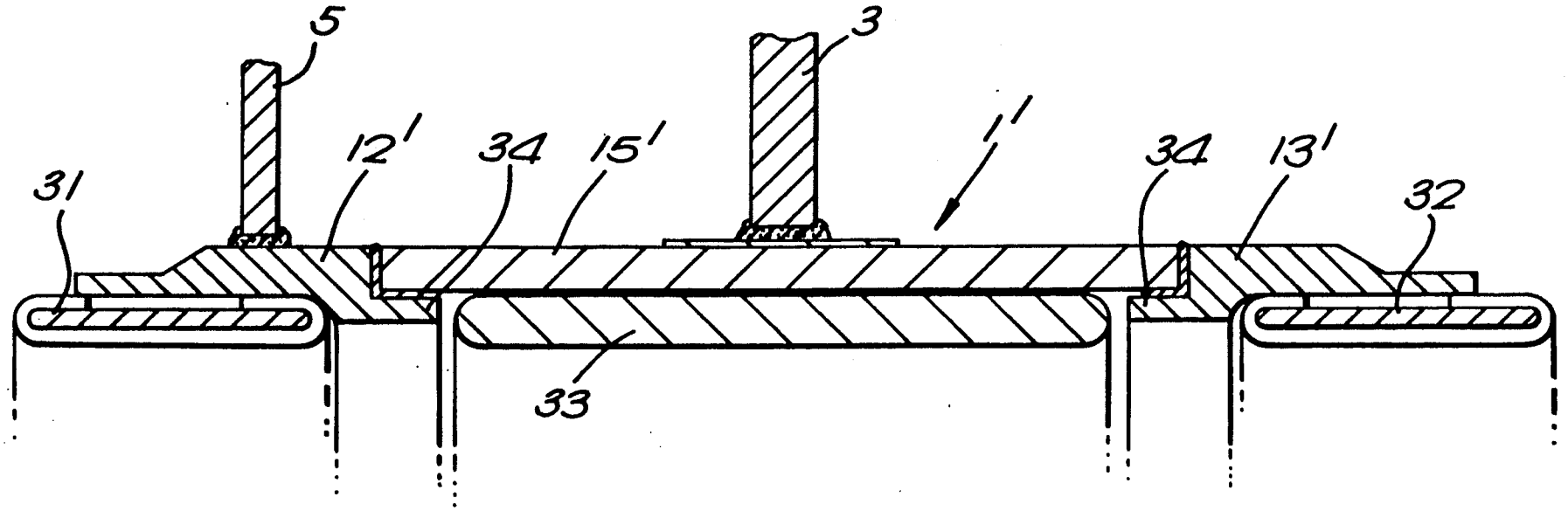
FIG. 3 is a sectional side elevation of an alternative assembly.

If a $\pi$ network is required and the ferrite bead 19 in the arrangement of FIGS. 1 and 2 does not provide sufficient inductance, the socket member can be modified in various ways. For example, the metal support tube 10 could be replaced by a tube of a ferrite material. Alternatively, two socket members could be employed arranged end-to-end and separated by a ferrite inductor. Another, modified construction that enables an increased inductance is shown in FIG. 3. In this arrangement, the socket member 1' has been lengthened and is provided with two separate Hypertac type electrical socket elements 31 and 32 at opposite ends. A ferrite tube 33 extends coaxially within the tubular capacitor 15' and makes direct sliding contact with a pin element inserted within the socket member. The shape of each end bush 12' and 13' is modified slightly over those used in the previous arrangement to include a neck 34 of reduced diameter at their inner ends which extends a short distance within opposite ends of the tubular capacitor 15'. Electrically, the capacitor 15' is connected intermediate both socket elements 31 and 32 and the ground plane 3.

Figure 6:
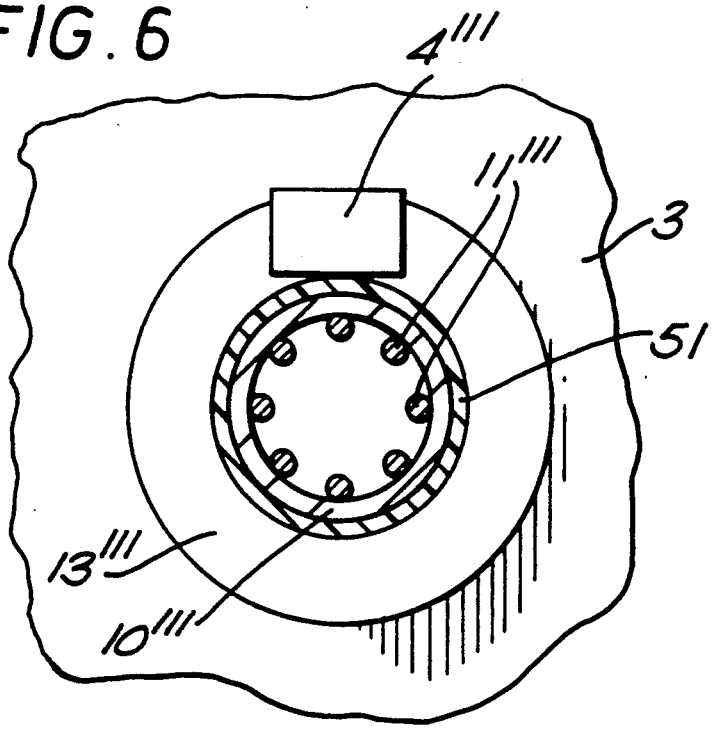
FIG. 6 is a transverse section along the line VI—VI of FIG. 5.
Figure 4:
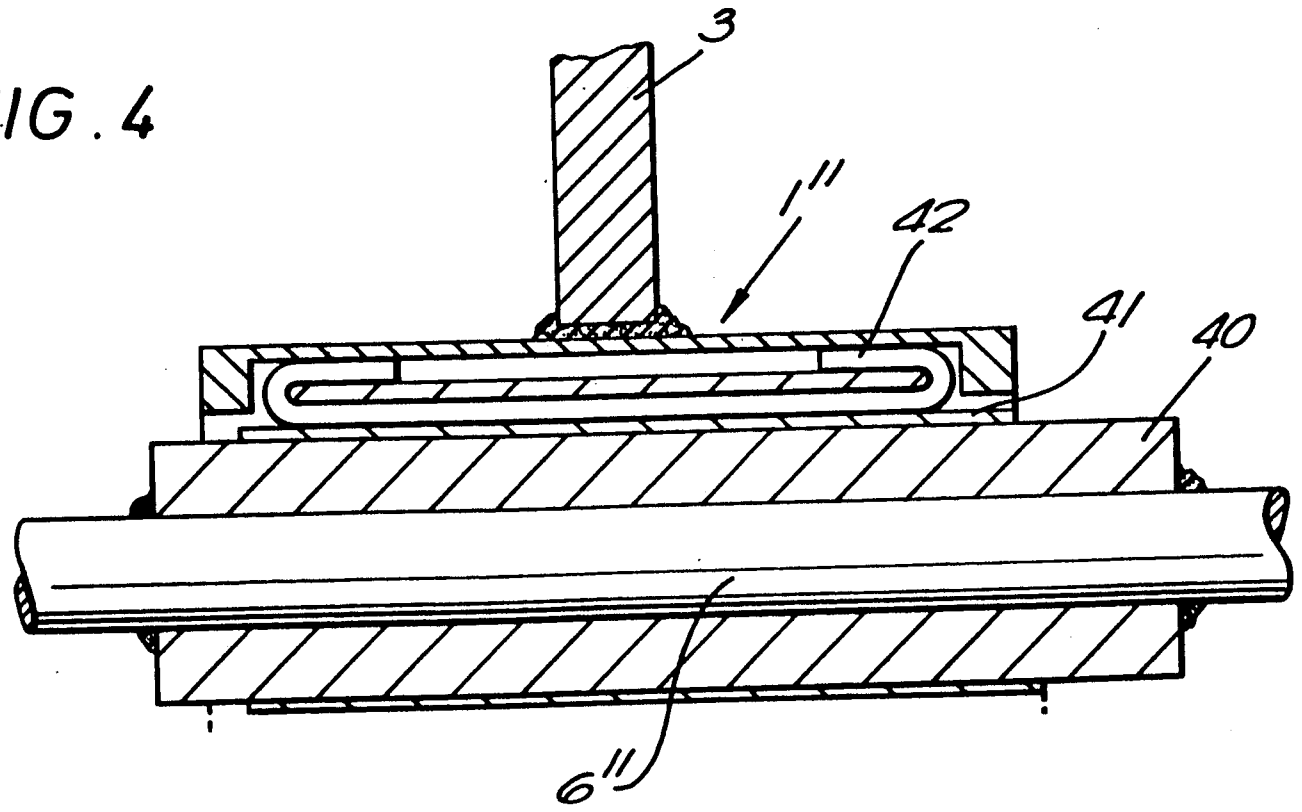
FIG. 4 is a sectional side elevation of another alternative assembly.
Figure 5:
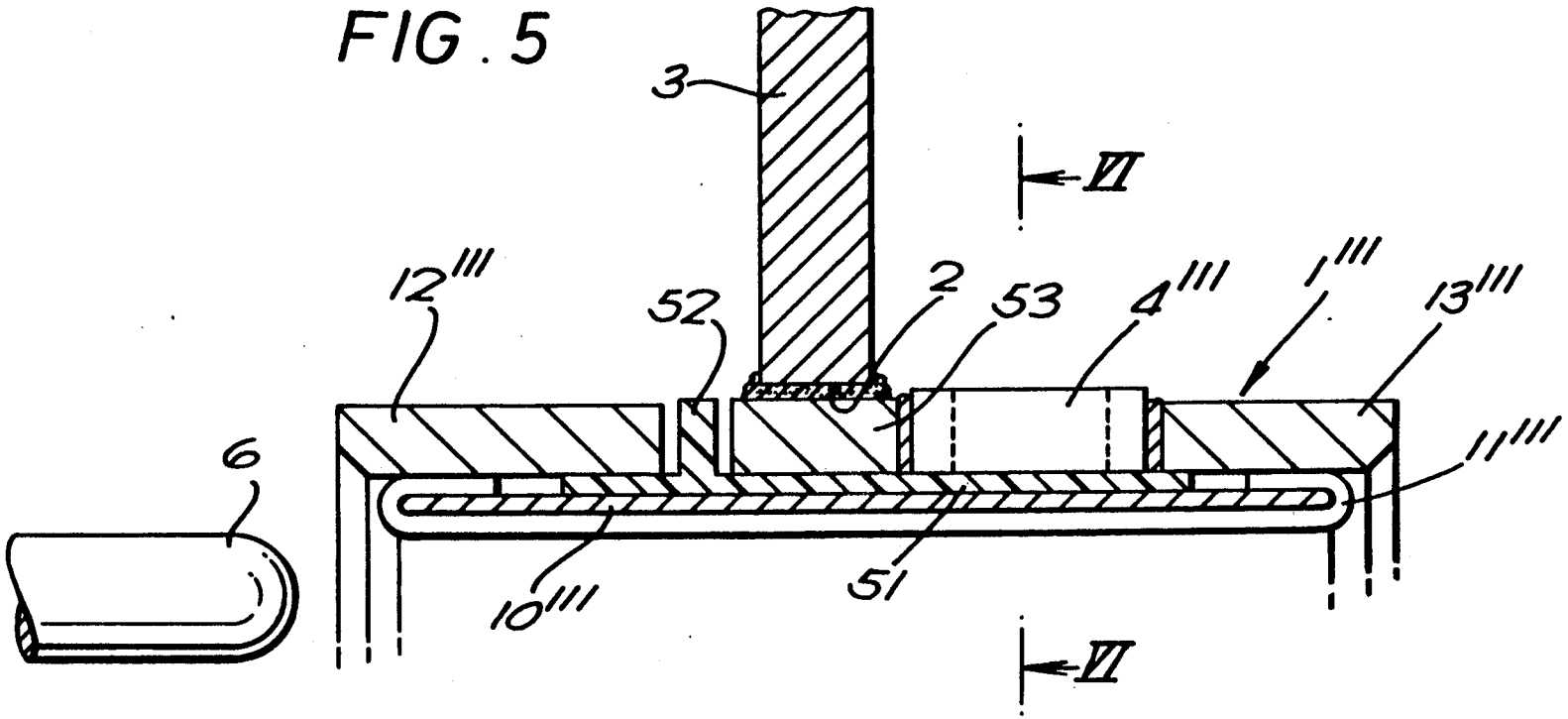
FIG. 5 is a sectional side elevation of a further alternative assembly.

It is not essential for the tubular capacitor to be located on the outside of the socket member. In FIG. 4 there is shown an alternative construction employing a tubular capacitor 40 that is soldered directly onto the pin 6''. The outer surface of the capacitor has a plated metal surface electrode 41 such as of gold which makes sliding contact with the inner surface of a Hypertac type electrical socket element 42. In this arrangement, the capacitor 40 forms a part of the socket member 1'' although it is more readily removable from it for replacement and servicing.

Where only protection against transients is required, the electrical device can take the form shown in FIGS. 5 and 6. In this arrangement the socket member 1''' includes a metal support tube 10''' and wires 11''' similar to that of the FIG. 1 arrangement. Metal end bushes 12''' and 13''' secure the wires 11''' to the tube where they are folded back along its outside. The pin 6 makes sliding electrical contact with the wires 11''' when inserted through the socket member 1'''. The metal tube 10''' is insulated on its outer surface by an electrically insulative sleeve 51. The left hand end of the insulative sleeve 51 extends within the left hand bush 12''' and has an annular flange 52 that extends radially to the right of the bush 12'''. A metal collar 53 embraces the insulative sleeve 51 to the right of the flange 52 and is soldered into the aperture 2 in the ground plane 3. Between the right end bush 13''' and the collar 53 there is soldered a transient protection device 4'''. This is of rectangular shape having approximately the same thickness as the right end bush 13''' and the collar 53. When a high voltage transient occurs, this is conducted from the pin 6 via the wires 11''' and metal support tube 10''' to the right end bush 13'''. The transient protection device 4''', which is normally non conductive, will be forced to conduct by the high voltage across it and the transient voltage will be conducted via the collar 53 to the ground plane 3.

All the above arrangements lead to a compact arrangement which enables dense packing of the sockets. Servicing is facilitated because any socket with a filtering device can be unsoldered readily from the ground plane without disturbing other ones of the sockets.

What I claim is:

1. An electrical assembly for making connection with a plurality of pin elements, the assembly comprising: a ground plane member, a plurality of socket members, and means mounting each socket member with and extending through the ground plane member, each socket member being shaped to receive a respective one the pine elements, each socket member including within it capacitor means, an inductive element, and a plurality of spring wire elements disposed around the socket member and extending obliquely of the axis of the socket member, the spring wire elements making resilient sliding contact around a surface of a respective pin element inserted in the socket member at least at opposite ends of the socket member, and the spring wire elements making electrical contact with opposite ends of the capacitor means, the ground plane member making electrical connection with the capacitor means intermediate its ends so as to form two capacitor elements of a $\pi$ filter circuit, the inductive element being located between opposite ends of the capacitor means, and each pin element being so shaped that it can be slid into and out of the assembly without disturbing others of the pin elements.

2. An electrical assembly according to claim 1, wherein the socket member includes an electrically-conductive sleeve and wherein said spring wire elements are supported by the conductive sleeve.

3. An electrical assembly according to claim 1, wherein the inductive element is of a ferrite.

4. An electrical assembly according to claim 1, wherein the assembly further includes a transient protector, and a board separate from the ground plane member, and wherein the transient protector is mounted on said board.

5. An electrical assembly according to claim 1 wherein the capacitor means and inductive element are each of tubular shape and extend coaxially of the socket member.

6. An electrical assembly according to claim 5, wherein the inductive element is located internally within the tubular capacitor means.

* * * * *